US005290204A

United States Patent [19]

Lee

[11] Patent Number: 5,290,204

[45] Date of Patent: Mar. 1, 1994

[54] COMPACT PEDALING SPORTING APPARATUS

[76] Inventor: Michael Lee, 7F, No. 164, Nanking East Road, Section 4, Taipei, Taiwan

[21] Appl. No.: 983,311

[22] Filed: Nov. 30, 1992

[51] Int. Cl.[5] ..... A63B 22/04

[52] U.S. Cl. ..... 482/53; 482/112

[58] Field of Search ..... 482/51, 52, 53, 111, 482/112, 79, 80

[56] References Cited

U.S. PATENT DOCUMENTS 4,563,001 1/1986 Terauds ..... 482/112

5,062,627 11/1991 Bingham ..... 482/53

*Primary Examiner*—Stephen R. Crow

*Attorney, Agent, or Firm*—Bacon & Thomas

[57] ABSTRACT

A compact pedal exercise apparatus having a stand, a swing mechanism, pedal swing rods, cylinders, and motion link, to form an exercise apparatus with ease of operation. The pedal swing rods are pivotally attached to the stand and each swing rod has a cylinder damper between it and the stand. A movable height adjusting mechanism is interposed between the stand and the pedal swing rods so that a user may easily adjust the amount of movement of each pedal swing rod relative to the stand.

5 Claims, 4 Drawing Sheets

COMPACT PEDALING SPORTING APPARATUS

BACKGROUND OF THE INVENTION

The progress of recent times along with the development of business, have resulted in an increased living standard throughout society. All the basic requirements, such as food, clothing, residence, and transportation are not only fulfilled, but are also comfortable. Most people enjoy the taste of delicious foods and the convenience of vehicles, so that they tend to eat too much and get insufficient exercise. Therefore people become overweight, and suffer other pathological changes due to lack of exercise. Some don't have free time to exercise because of busy work; and some because the scarcity of sporting fields. Various exercise apparatus have been introduced into the market. The types and purposes of these apparatus are typically imitations of sport items or of general activities.

SUMMARY OF THE INVENTION

The compact pedaling exercise apparatus of the present invention includes a stand and a swing mechanism which is fitted on the stand. The swing mechanism is incorporated in a swing mechanism fixed frame of the stand. Pedal swing rods are incorporated on two sides of the swing mechanism respectively. The swing mechanism and the pedal stand rods are connected with a cross motion link. The cross motion link is a structure having two holes, with the axes of the holes crossing each other but displaced so as to not intersect. A cylinder is connected between each pedal swing rod and the stand. One end of the pedal swing rod is fixed to the stand to enable the pedal swing rods to swing up and down. By means of the aforementioned structure when a user steps on the pedal swing rods, the pedal swing rods will swing up and down. The cylinder works as a damper, therefore a stable transmission can be achieved through the connection of said cross motion link, and no wobble will be generated.

DETAILED DESCRIPTION OF THE INVENTION

Figure 1:
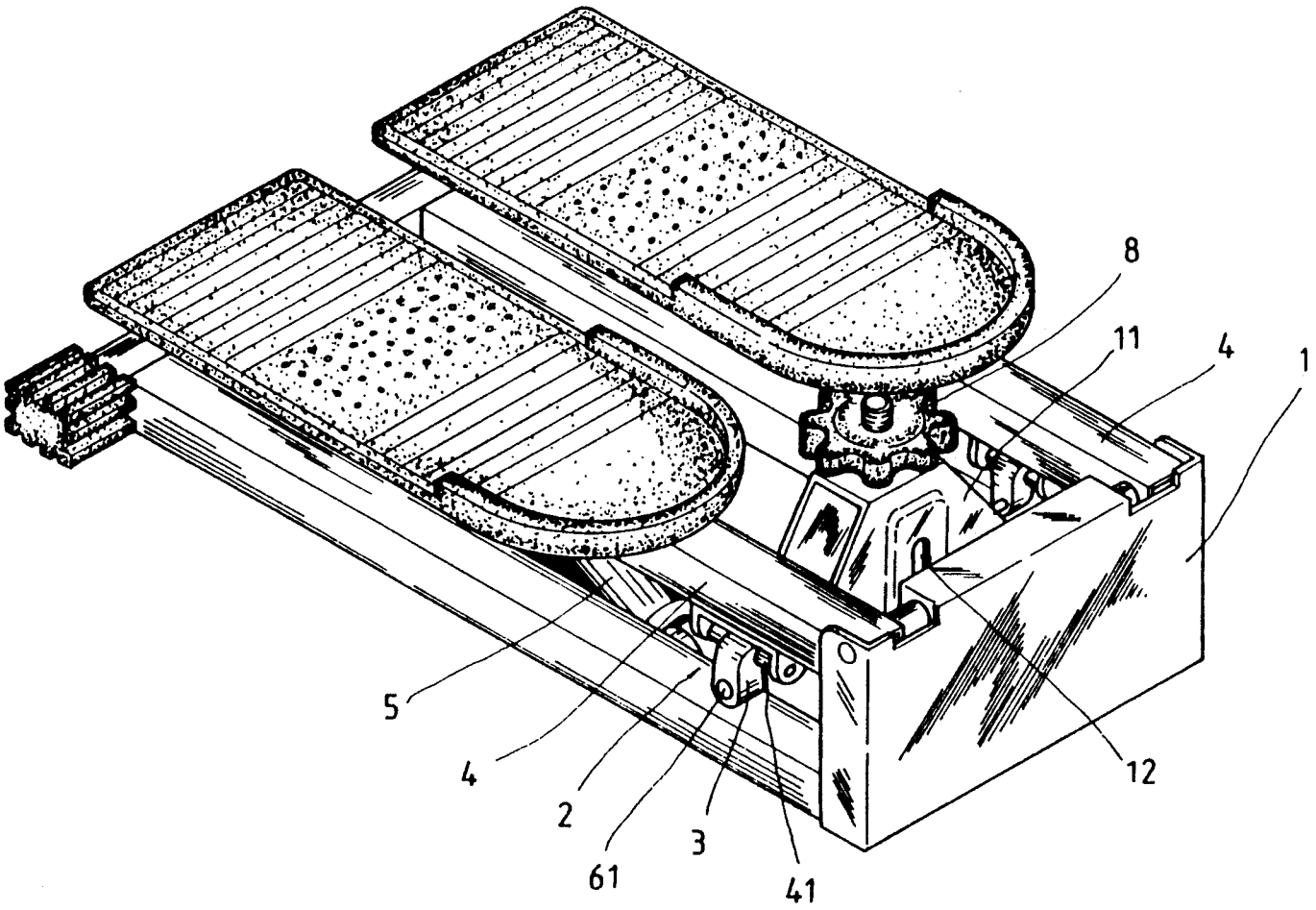
FIG. 1 is a perspective view of the present invention.
Figure 2:
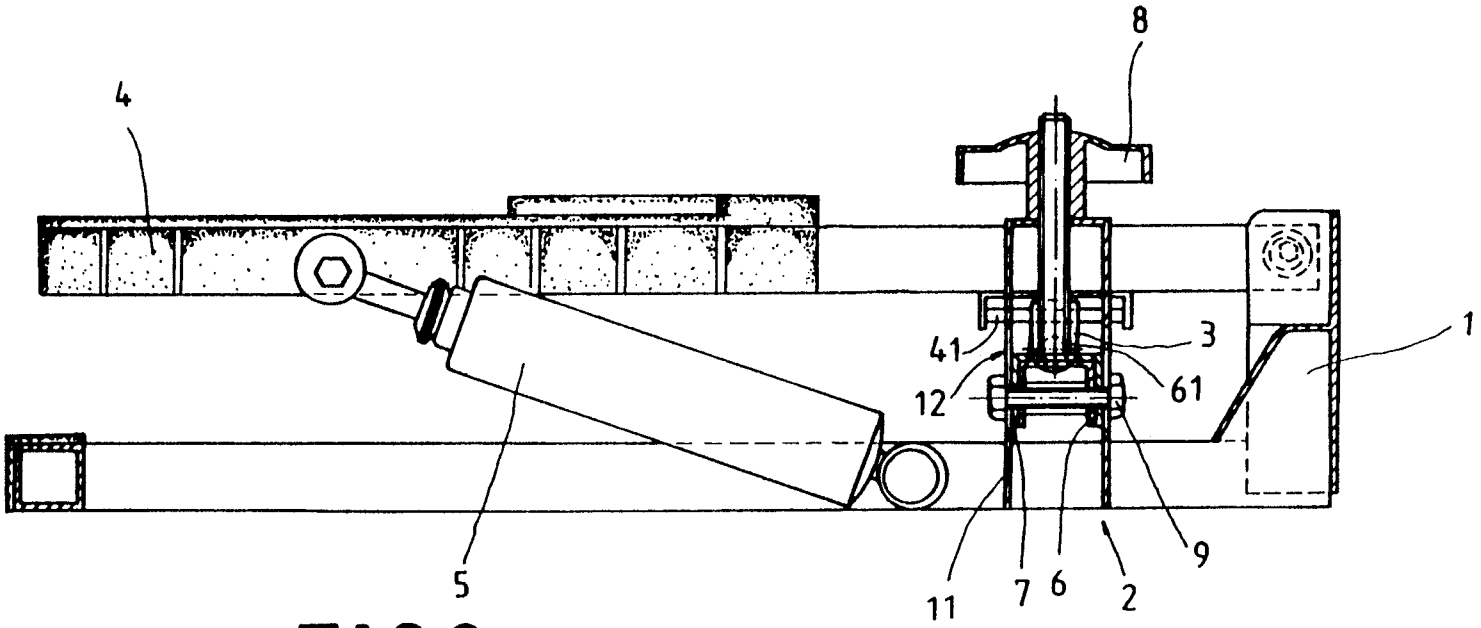
FIG. 2 is a cross-sectional view of the present invention taken along line II—II in FIG. 3.
Figure 3:
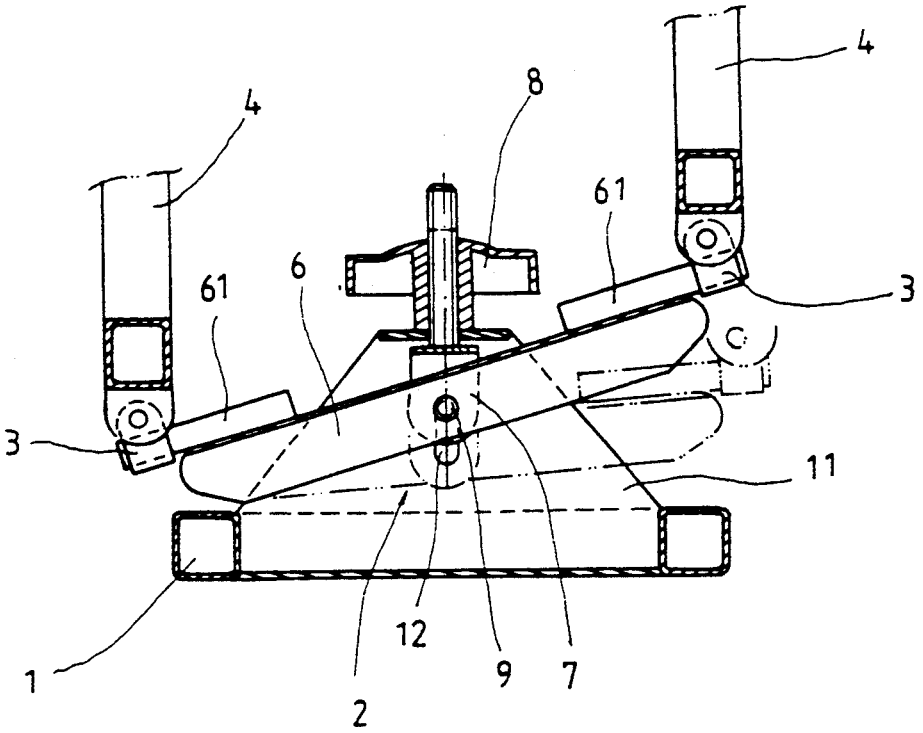
FIG. 3 is a cross-sectional view of the present invention taken along line III—III in FIG. 2.
Figure 4:
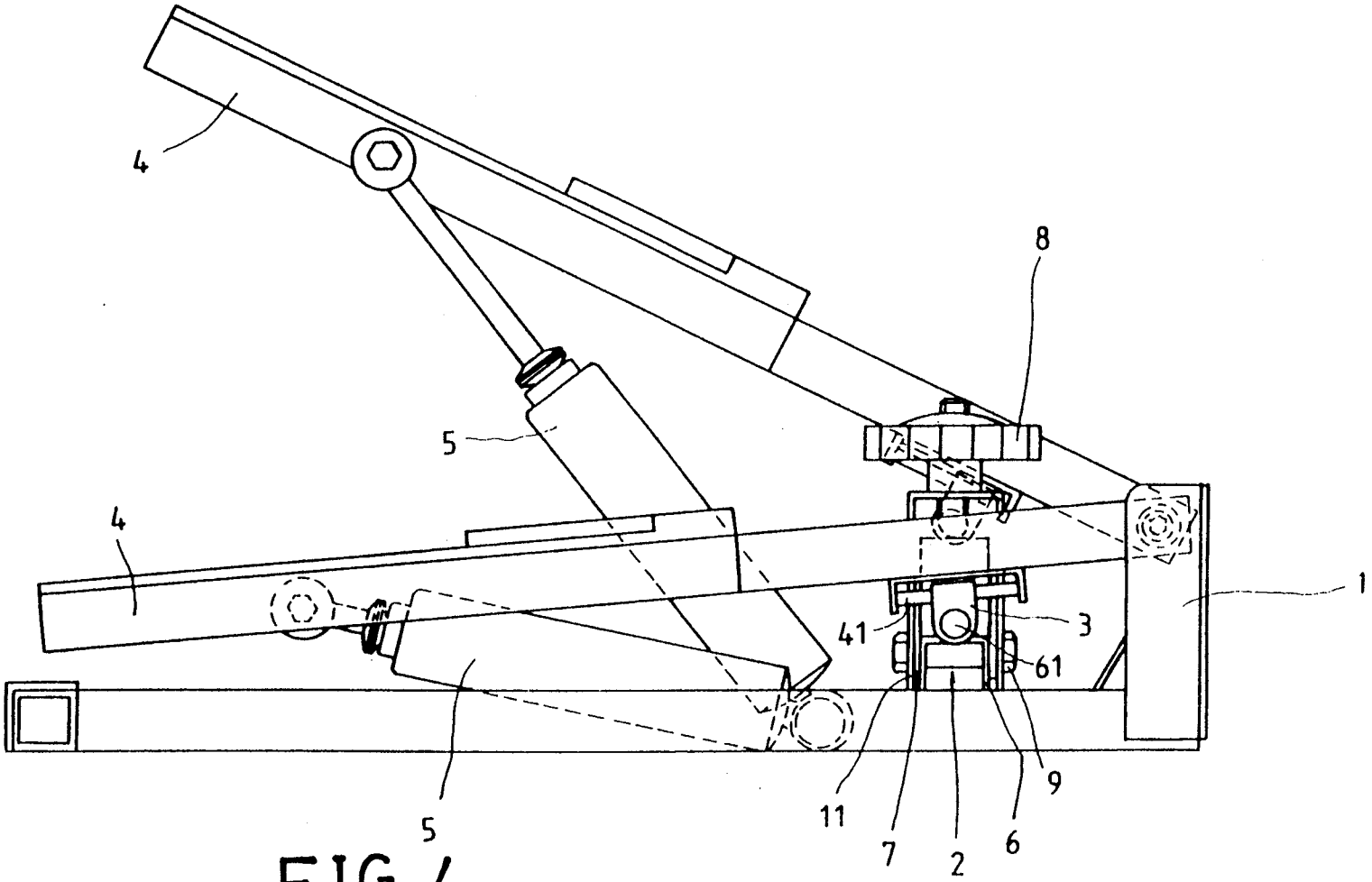
FIG. 4 is a side view of the preferred embodiment according to the present invention.

As seen in FIGS. 1-3, the present invention includes a stand 1 and a swing mechanism 2 which is fitted on the stand 1. The swing mechanism 2 is incorporated in a swing mechanism fixed frame 11 of the stand 1. A cross motion link 3 is connected between each side of the swing mechanism 2 and a pedal swing rod 4 respectively. A cylinder 5 is connected between each pedal swing rod 4 and the stand 1 respectively. One end of each pedal swing rod 4 is fixed in the stand 1 by pins. The swing mechanism 2 is composed of a lever 6 and a U-shaped height adjustment plate 7. A round rod 61 is incorporated in each end of the lever 6 respectively. The U-shaped height adjustment plate 7 includes a U-shaped plate and a screw secured to the plate. A height adjustment knob 8 is incorporated in the screw. The U-shaped plate of 7 is fitted on lever 6, and is secured to the lever 6 with a screw 9. The screw 9 also penetrates both sides of the swing mechanism fixed frame 11 in the stand 1. An elongated slot 12 is incorporated in each side of the swing mechanism fixed frame 11 respectively. The screw 9 extends through both elongated slots of swing mechanism fixed frame 11. The screw of the U-shaped plate extends through a top of the swing mechanism fixed frame 11. The height adjustment knob 8 is then connected with the screw of said U-shaped plate. The round rods 61 on the lever 6 are fitted into one hole of each cross motion link 3 respectively. The cross motion link 3 is a structure having two round holes which overlap each other, but which do not intersect. The other hole of cross motion link 3 is penetrated by a slide bar 41 of the pedal swing rod 4. The slide bar 41 is fixed on a U-frame which is secured on the said pedal swing rod 4. By means of the aforementioned structure, while a user steps on the pedal swing rods 4, the two pedal swing rods 4 will swing up and down. The cylinder 5 will work as a damper. If the swing arc of the two pedal swing rods 4 is to be adjusted, the adjustment can be made by turning the height adjustment knob 8. Through the turning of the height adjustment knob 8, the lever 6 can be moved up or down by the U-shape height adjustment plate 7, and the height of said lever 6 can thereby be adjusted. Therefore, the swing arc can be adjusted accordingly due to the change of the supporting point of the pedal swing rods.

According to the aforementioned structure, a preferred embodiment of the present invention is shown in the figures, when a user is pedaling on the pedal swing rods 4, a force is applied to either of the two pedal swing rods 4. Therefore, only one of the two pedal swing rods 4 will swing down. The lever 6 will be swung down in the direction of the pedal swing rod 4 to which force is applied, through the connection of one cross motion link 3. The pedal swing rod 4 will be moved up by the swung-up end of lever 6, through the connection of other cross motion link 3. Through the damper function of the two cylinders 5, the two pedal swing rods 4 can swing slowly.

As the cross motion link 3 is connected between each of the pedal swing rods 4 and the lever 6 respectively, a stable transmission can be generated to achieve a smooth operation, and the structure can be protected from damage.

If a user wishes to perform a minimum amount of exercise, the height adjustment knob 8 can be turned so as to descend the lever 6 to its lowest point. Therefore, the swing arc of the pedal swing rods 4 will be reduced accordingly. On the contrary, if a user wishes to perform a more strenuous exercise, the height adjustment knob 8 can be turned in the reverse direction to raise the lever 6, so that the supporting point of said lever 6 will be higher. Therefore, the swing arc of the pedal swing rods 4 will be increased accordingly, so that exercise similar to the actions of stepping up the stairs can be performed.

As the integrated design of the present invention is very compact, it can be used in virtually any place, such as a balcony, living room, or bedroom. Of course, the present invention can also be used in larger places, such as a courtyard or open space, so that the exercise can be performed at any location. Advantageously, the use of the present invention will not be limited by the size of the place; it is easy to carry and transport because of its compact volume and lighter weight; and may be conveniently stored.

Therefore, the major object of the present invention is to provide a swing mechanism 2 which is fitted on the stand 1. Through the turning of the height adjustment knob 8, the U-shaped height adjustment plate 7 can be raised or lowered, adjusting the height of the supporting point of lever 6 upwardly or downwardly, and the swing arc of pedal swing rods can be adjusted accordingly.

The other object of the present invention is to provide a cross motion link 3 which is connected between the lever 6 and the pedal swing rods 4. Therefore, a stable transmission can be generated to achieve a smooth operation, and the structure can be protected from damage.

The further object of the present invention is to provide a sporting apparatus with compact volume and lighter weight. Therefore the present invention can be used at any place and is easy to carry and store.

I claim:

1. A compact pedal exercise apparatus comprising:

a) a stand;

b) a swing mechanism attached to the stand, the swing mechanism comprising:

i) a generally "U"-shaped height adjustment plate movably attached to the stand;

ii) a lever pivotally attached to the height adjustment plate, the lever having opposite ends and a rod extending from each opposite end; and, iii) means to adjust the position of the height adjustment plate and lever with respect to the stand; the means including a first screw secured to the height adjustment plate and a height adjusting knob operatively associated with the screw;

c) a pair of pedal swing rods attached to the stand for user support; and, d) a pair of cross-motion link members each pivotally connected to a respective one of the pedal swing rods and to the rod extending from an end of the lever.

2. A compact pedal exercise apparatus as claimed in claim 1 further comprising:

a) means for pivotally connecting an end of each pedal swing rod to the stand to form a pivoted supporting point; and, b) a cylinder connected to the stand and to the pedal swing rod such that the pedal swing rods can swing up and down.

3. A compact pedal exercise apparatus as claimed in claim 1 further comprising a swing mechanism fixed frame attached to the stand and defining elongated slots wherein the U-shaped plate is attached to the fixed frame by a second screw extending through the U-shaped plate, the lever, and the elongated slots defined by the swing mechanism fixed frame.

4. A compact pedal exercise apparatus as claimed in claim 3, wherein the first screw extends through a top of the swing mechanism fixed frame and wherein the height adjustment knob is secured to the first screw.

5. A compact pedal exercise apparatus as claimed in claim 4 further comprising a slide bar attached to each pedal swing rod and pivotally attached to one of the cross-motion link members.

* * * * *